US007878787B2

(12) United States Patent
Nilsson et al.

(10) Patent No.: US 7,878,787 B2
(45) Date of Patent: Feb. 1, 2011

(54) FORMING TOOL FOR MAKING FIBRE OBJECTS

(75) Inventors: Björn Nilsson, Kimstad (SE); Lars Graffton, Bettna (SE); Leif Båskman, Norrköping (SE); Robert Eriksson, Norrköping (DE)

(73) Assignee: PAKIT International Trading Company Inc., Upton, St. Michael (BB)

( * ) Notice: Subject to any disclaimer, the term of this patent is extended or adjusted under 35 U.S.C. 154(b) by 0 days.

(21) Appl. No.: 12/096,405

(22) PCT Filed: Jan. 17, 2007

(86) PCT No.: PCT/SE2007/050026

§ 371 (c)(1),
(2), (4) Date: Jun. 6, 2008

(87) PCT Pub. No.: WO2007/084067

PCT Pub. Date: Jul. 26, 2007

(65) Prior Publication Data

US 2008/0279976 A1 Nov. 13, 2008

(30) Foreign Application Priority Data

Jan. 18, 2006 (SE) ..... 0600108

(51) Int. Cl.
*B28B 1/26* (2006.01)
*D21J 3/00* (2006.01)

(52) U.S. Cl. ..... 425/85; 249/113; 162/382

(58) Field of Classification Search ..... 425/85, 425/412; 249/113, 122; 162/382
See application file for complete search history.

(56) References Cited

U.S. PATENT DOCUMENTS

| | | | | | |
|---|---|---|---|---|---|
| 2,903,062 | A * | 9/1959 | Lambert | ..... | 249/113 |
| 3,284,284 | A * | 11/1966 | Wells | ..... | 162/218 |
| 3,932,096 | A * | 1/1976 | Kartman | ..... | 425/398 |
| 4,125,351 | A * | 11/1978 | Alfter et al. | ..... | 425/403 |
| 4,272,318 | A * | 6/1981 | Walker et al. | ..... | 162/382 |
| 5,431,784 | A * | 7/1995 | Miyamoto et al. | ..... | 162/275 |
| 6,149,772 | A | 11/2000 | Rasmussen | | |
| 6,582,562 | B2 * | 6/2003 | Gale et al. | ..... | 162/382 |
| 2001/0035275 | A1 * | 11/2001 | Gale et al. | ..... | 162/382 |

FOREIGN PATENT DOCUMENTS

| | | | |
|---|---|---|---|
| DE | 3837467 | A1 | 5/1990 |
| EP | 0559490 | A1 | 9/1993 |
| EP | 0719894 | A1 | 7/1996 |
| EP | 1197596 | A1 | 4/2002 |

(Continued)

OTHER PUBLICATIONS

Office Action from Australian IP Office dated Dec. 1, 2009.

(Continued)

*Primary Examiner*—Maria Veronica D Ewald
(74) *Attorney, Agent, or Firm*—King & Spalding LLP

(57) ABSTRACT

The invention relates to a forming tool 1 for forming fiber products. The forming tool according to the invention comprises a permeable shell 3 with an internal cavity 5 that is filled with loose objects 6 such as spheres. The cavity 5 is enclosed by the shell 3 and a permeable cover 7.

15 Claims, 9 Drawing Sheets

FOREIGN PATENT DOCUMENTS

| | | |
|---|---|---|
| GB | 2 074 085 | 10/1981 |
| JP | 05-247900 | 2/1993 |
| JP | 07-070997 | 3/1995 |
| JP | 07-0709977 | 3/1995 |
| JP | 10-088500 | 4/1998 |
| JP | 10-195800 | 7/1998 |
| JP | 2002-088699 | 3/2002 |
| JP | 2003-102762 | 4/2003 |
| JP | 2004-131154 | 4/2004 |
| WO | 03/035981 | 1/2003 |

OTHER PUBLICATIONS

Notification of Reasons for Refusal; Japanese Patent Application No. 2007-542983; Nov. 4, 2010.

* cited by examiner

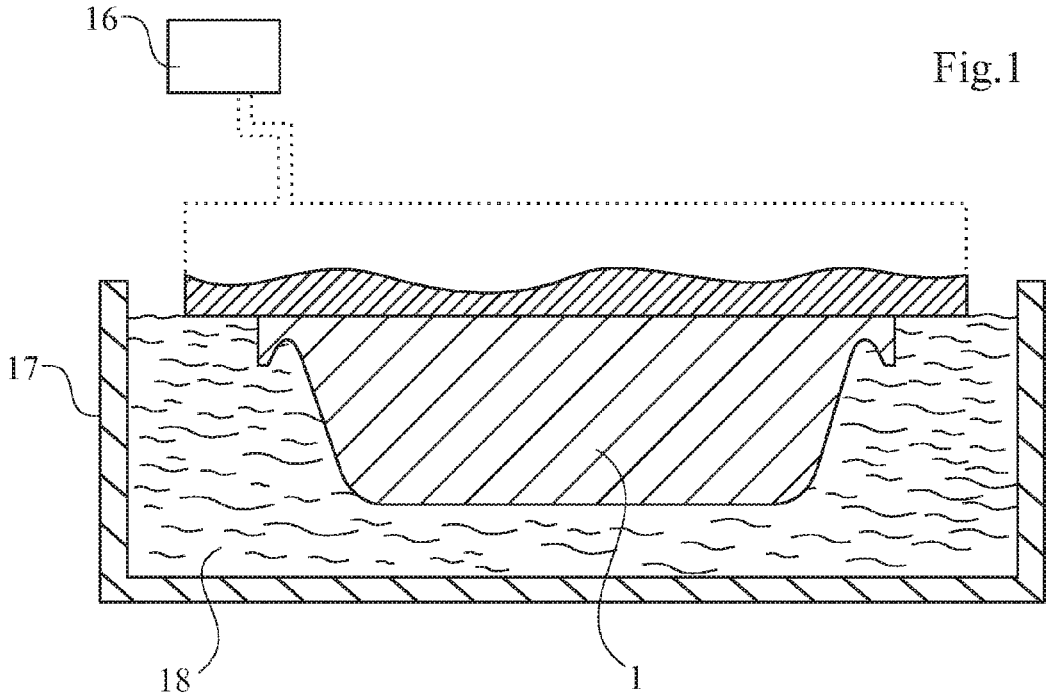
Fig.1
Fig.2
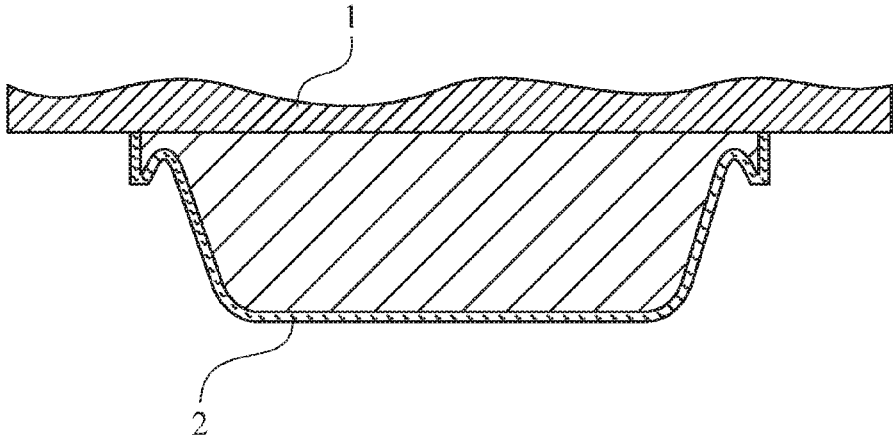

Fig.10
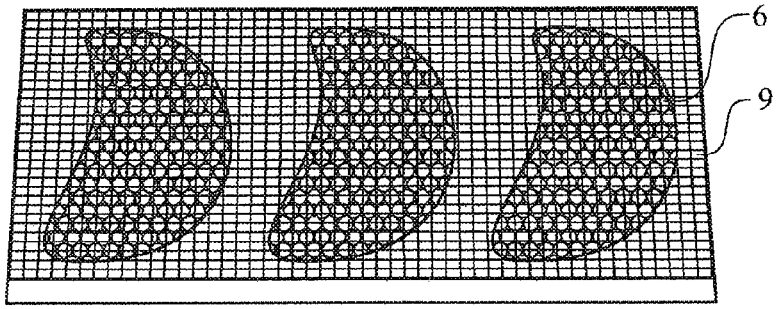
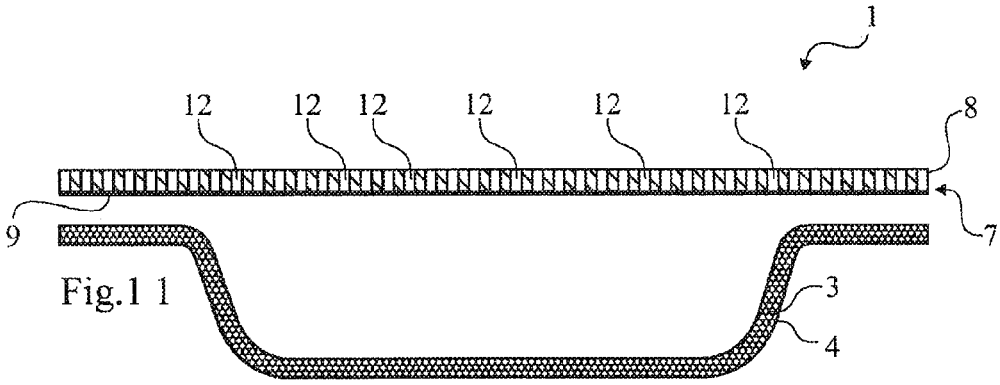
Fig.1 1
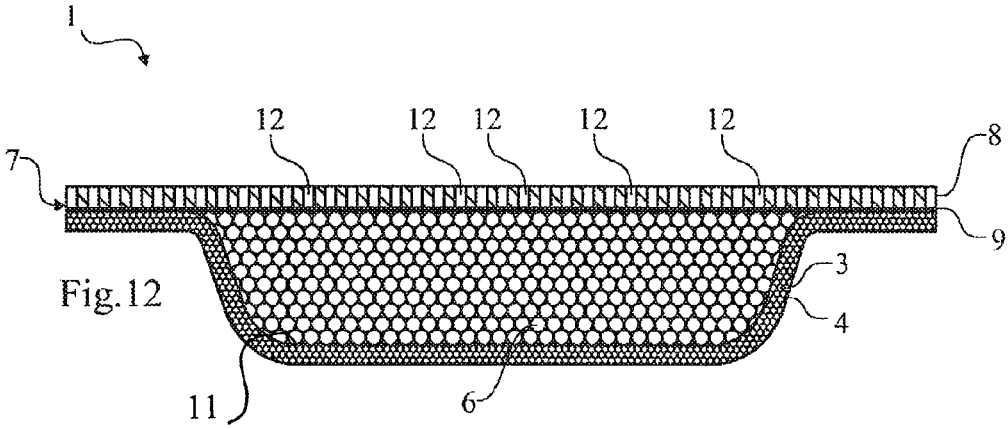
Fig.12

FORMING TOOL FOR MAKING FIBRE OBJECTS

This application is a section 371 of and claims priority to international application PCT/SE2007/050026 filed on Jan. 17, 2007, which designated the United States and which was published in the English Language on Jul. 26, 2007 as WO 2007/084067 A1 and claims the benefit of Sweden SE 0600108-5, filed on Jan. 18, 2006. The entire contents of each of the foregoing related applications are hereby incorporated herein by reference.

FIELD OF THE INVENTION

The invention relates to a permeable forming tool for making fibre objects. The forming tool is intended to be immersed in a fibre suspension or stock and an embryonic fibre product can then be formed on the tool through application of suction through the permeable tool.

BACKGROUND OF THE INVENTION

Fibre products such as for example egg boxes can be made from stock in a process where a fibre layer is created and shaped to a desired form whereafter the so shaped fibre product is dewatered and possibly subjected to some form of post-processing operation.

U.S. Pat. No. 6,103,179 discloses a method for producing a fibre product which is where a first male mould is immersed in a moulding tank containing stock. By means of vacuum, a fibre layer of predetermined thickness for the fibre product is formed. The first male mould is then removed from the moulding tank. A cyclical sequence of movements is performed with a female mould in which, in a first pressing stage, the female mould is brought under force against the male mould so that a first expressing of stock water occurs following which the fibre product is transferred to the female mould which is moved to a second position. The fibre product is then subjected to a second expressing whereafter the fibre product is subjected to final drying using microwave or IR radiation.

U.S. Pat. No. 5,603,808 discloses a mould for making pulp mouldings that includes a reticulate resin mould part of a three-dimensional shape. The resin mould part is metallized for reinforcement and mounted on a support member made of a resin, metal or aggregate. The support member has substantially the same three-dimensional shape as that of the reticulate resin mould and has openings to discharge water from openings of the metallized resin mould part. In one embodiment, the support member has a body of coarse particles bound together to form a porous structure. The particles of the porous structure are bound together by a binder or by sintering them.

It is desirable that forming tools for fibre objects be firm and strong such that they can withstand both underpressure and pressure that is caused by contact with counter-tools, for example during a pressing operation. It is also desirable that they have a sufficient permeability such that water may easily pass through the forming tools. In case fibres should accumulate inside a forming tool, it is also desirable that the tool can be cleaned from such fibres. It is also desirable that forming tools can be manufactured easily and at a low cost. With this in mind, the present invention has been developed in order to offer an improved forming tool for making fibre objects.

DISCLOSURE OF THE INVENTION

The invention relates to a forming tool for fibre objects. The inventive tool comprises a permeable shell of sintered particles. The shell partially encloses an inner cavity of the tool which is filled with loose objects. The tool further comprises a permeable cover that together with the permeable shell encloses the cavity such that the loose objects are enclosed between the cover and an inner wall of the shell. In one embodiment, the loose objects are spherical particles and they may be made of a plastic material.

In one embodiment, the permeable shell of the forming tool has an outer surface that corresponds to a male forming tool.

In embodiments of the invention, the permeable cover may comprise a relatively stiff cover plate and a flexible net. The stiff cover plate can be made of, for example, polyvinyl chloride.

In one embodiment, the stiff cover plate has through-holes that are larger than the loose objects and the net has a mesh size that is smaller than the loose objects.

The particles in the sintered shell may have an average diameter within the range of 0.1-5 mm and suitably 0.1 mm-2 mm.

In embodiments of the invention, the permeable cover may be removably attached to the permeable shell.

DESCRIPTION OF THE DRAWINGS

FIG. 1 is a schematic cross-sectional representation of a step in a process where a forming tool according to the invention may be used.

FIG. 2 is a cross-sectional representation of a further step in a process for forming a fibre object.

FIG. 10 shows in perspective how a net has been placed over the cavities where the spherical particles have been put.

FIG. 11 is a cross-sectional view showing some of the components of the present invention before the tool has been completely assembled.

FIG. 12 is a cross-sectional view of the forming tool when it has been assembled.

DETAILED DESCRIPTION OF THE INVENTION

Figure 3A:
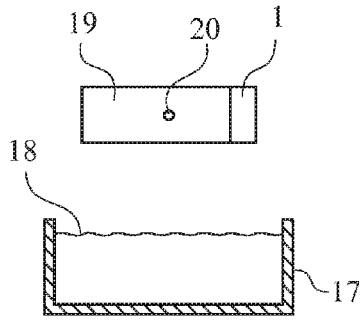
FIGS. 3*a*-3*c* show a sequence where a forming tool is immersed in a fibre suspension.

With reference to FIGS. 1-5, a process for making fibre objects is schematically illustrated. In FIG. 1, a forming tool 1 is shown immersed in a fibre suspension 18 that is contained in a tank 17. The tool 1 is a permeable tool 1 that is connected to a source 16 of underpressure or suction. When underpressure (suction) is applied to the tool, a fibre object 2 can be formed on the outer surface of the tool 1 as indicated in FIG. 2.

Figure 3B:
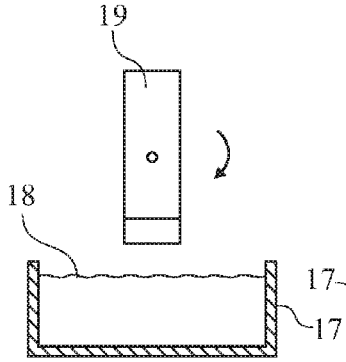
Figure 3C:
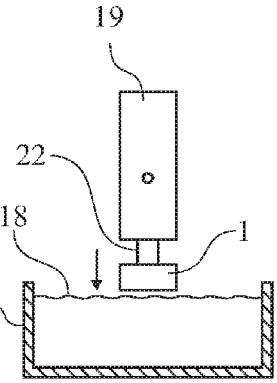
Figure 4A:
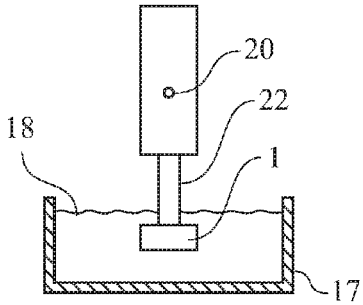
FIGS. 4*a*-4*c* show a sequence where a forming tool is taken up from the fibre suspension after a fibre object has been formed.
Figure 4B:
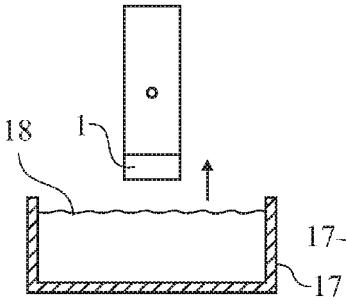
Figure 4C:
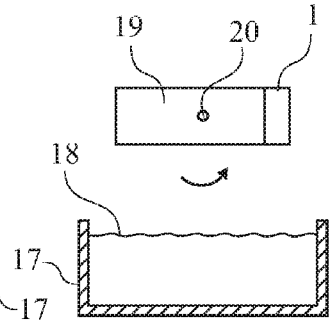
Figure 5A:
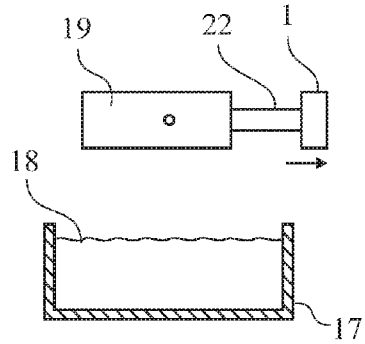
FIGS. 5*a*-5*c* show a sequence where the forming tool is brought into contact with another tool.
Figure 5B:
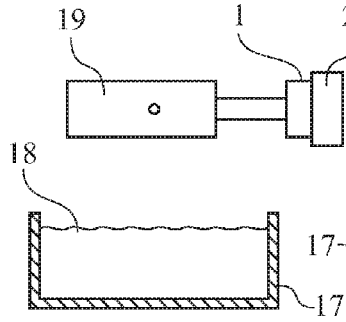
Figure 5C:
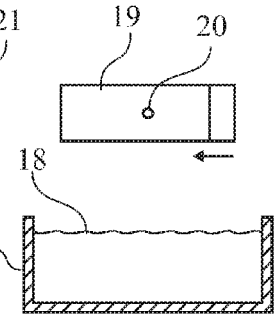

A possible cycle for making fibre objects is schematically illustrated in FIGS. 3*a*-3*c*, FIGS. 4*a*-4*c* and FIGS. 5*a*-5*c*. As indicated in FIGS. 3*a*-3*b*, a forming tool 1 can be mounted on a tool holder 19 that can pivot about an axis 20. The tool holder 19 may have an extendable arm 22 that allows the tool 1 to be moved into a tank 17 that contains a fibre suspension 18. When suction is applied to the tool 1, a fibre product 2 can be formed on the tool as indicated in FIG. 2. Once the fibre product 2 has been formed, the tool 1 can be lifted up from the tank 17 as indicated in FIGS. 4*a*-4*c*. The tool 1 can then be brought into contact with another tool 21 that can optionally be used for pressing water from the fibre product 2 in a nip formed between the tools 1 and 21. The tool 21 may also be used exclusively as a pick-up tool that simply picks up the fibre product 2 and transfers it to another work station (for example a press nip).

The design of the forming tool 1 shall now be explained with reference to FIGS. 6-12. As indicated in FIGS. 11 and 12, the forming tool according to the invention comprises a permeable shell 3 of sintered particles 4. The sintered particles 4 are preferably metal powder particles. Suitable particles for making such a shell can be obtained from, for example, Callo AB, with address Poppelgatan 15, S-571 39 NÄSSJÖ, SWEDEN. Callo AB sells metal powder particles having a chemical composition of 89% Cu and 11% Sn and it is believed that such particles may be suitable for making a permeable shell of sintered particles. Suitable particles can also be obtained from Makin Metal Powders Limited, Buckley Road, Rochdale, Lancashire OL12 9DT England. It should also be understood that the particles used to form the permeable shell 3 need not necessarily be based on copper. Other metal materials such as for example steel may also be considered. A steel material should preferably be a stainless steel material in order to better survive repeated exposure to water. The shell may have a porosity that is suitably in the range of 8-40%. The thickness of the permeable shell 3 may be, for example, in the range of 3 mm-20 mm. However, it should be understood that embodiments may be envisaged where the thickness of the permeable shell 3 exceeds 20 mm or is less than 3 mm. For example, the thickness of the shell 3 may conceivably have a thickness of 25 mm, 30 mm or 35 mm. For applications where a low weight and/or a high permeability is required, the thickness may be somewhat smaller, for example in the range of 3 mm-10 mm. For applications where the shell must be strong, a thicker shell may be desired, for example a shell having a thickness in the range of 8 mm-15 mm or 10 mm-20 mm.

The shell 3 may, at least in principle, be provided with through-holes. However, is porous. This makes it possible for the shell to form an outer surface that is a continuous surface. This surface is permeable in itself because it is porous. By using a shell with a continuous surface, dewatering of the fibre product can be made uniform, i.e. the dryness of formed fibre product will be evenly distributed.

The particles in the sintered shell may have an average diameter within the range of 0.01-5 mm, preferably 0.1 mm-2 mm. However, it should be understood that particles outside this range may also be considered.

The permeable shell 3 may be formed by many different methods. One way of forming such a shell 3 may include the use of a basic model tool having an exterior shape that corresponds to the shell 3 to be produced. Powder particles can then be applied onto the basic model to form a first layer. This can be repeated such that several layers of powder are formed on the basic model. The particles can then be heat treated, possible together with the basic model such that the particles form a sintered shell. The basic model can then be removed. If mainly copper-based particles are used, the sintering temperature may suitably be in the range of 800° C.-1000° C. If stainless steel particles are used, the sintering temperature may suitably be in the range of 1100° C.-1300° C. The time required for the sintering process may typically be about 0.5-2 hours. Sintering may be performed in a sintering furnace containing an appropriate atmosphere, for example $H_2$, $H_2$+$N_2$ or vacuum.

Figure 6:
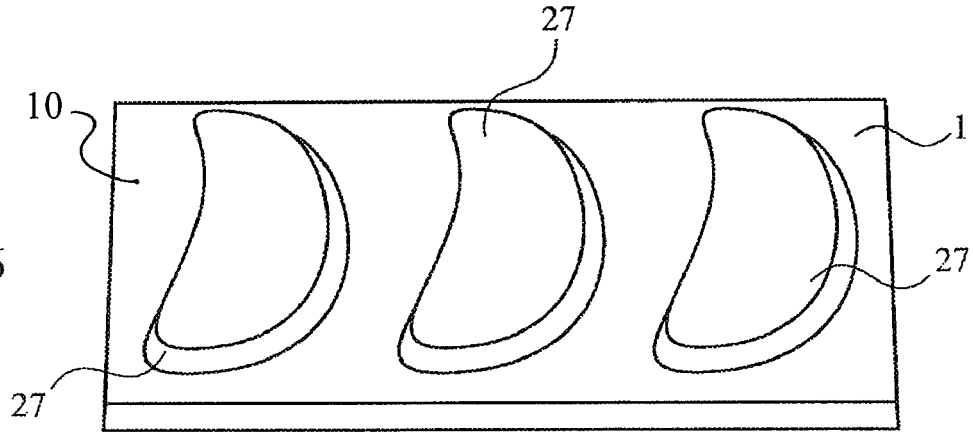
FIG. 6 is a perspective view of a shell for a forming tool according to the present invention.
Figure 7:
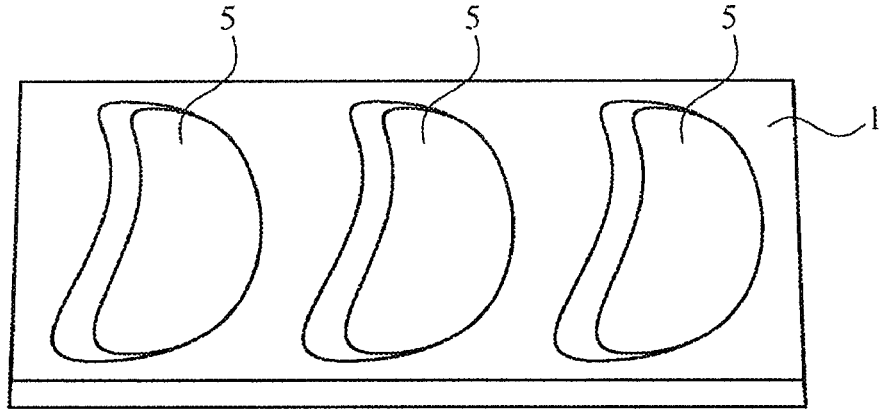
FIG. 7 is a perspective view of the same shell as in FIG. 6 but seen from the opposite side.
Figure 8:
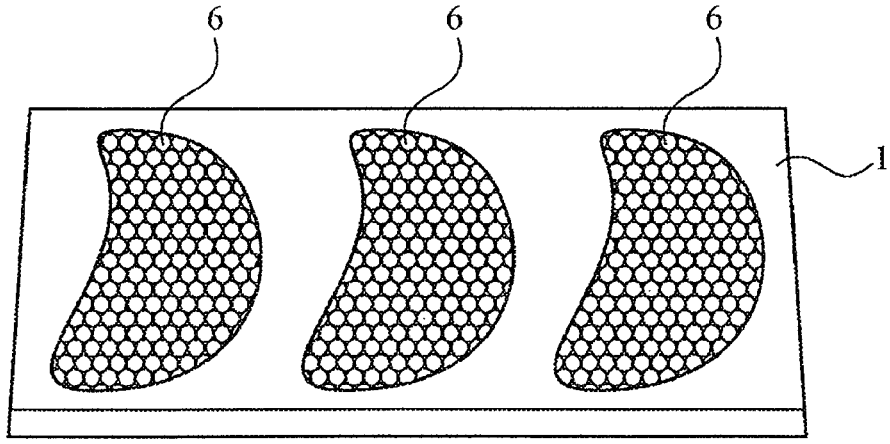
FIG. 8 shows a view similar to FIG. 7 but with spherical particles placed in the inner cavity or cavities of a tool.

The shell 3 partially encloses an inner cavity 5 which is filled with loose objects 6, i.e. a plurality of objects that are not bound to each other. The enclosure is completed by a permeable cover 7 that together with the permeable shell 3 encloses the cavity 5. In this way, the loose objects 6 are enclosed between the cover 7 and an inner wall 11 of the shell 3. According to an advantageous embodiment of the invention, the loose objects 6 are spherical objects (i.e. shaped as spheres). If spherical objects are used, the passageways for the liquid will be of relatively uniform permeability which can improve performance of the tool 1. However, it should be understood that also other objects than spherical objects may be considered. For example, the loose objects 6 could be irregular objects or be shaped as regular polyhedrons. Preferably, although not necessarily, the loose objects 6 are made of a plastic material. Other possible materials for the loose objects 6 include, but are not restricted to, glass or metal. Thus, according to one embodiment of the invention, the loose objects could be spherical objects (balls) of a plastic material. In another embodiment, they could be irregular objects of a plastic material. In yet another embodiment, they could be decahedrons made of glass. It should be understood that these possibilities are mentioned only as examples of what can be envisaged. In many realistic and suitable embodiments of the invention, the loose objects may be about 5 mm-25 mm. For example, they could be plastic spheres with a diameter of 5 mm-25 mm. However, it should be understood that other dimensions are also possible As indicated in FIGS. 6 and 7, the permeable shell 3 partially encloses an inner cavity 5 and the shell may actually be shaped in such a way that it has a plurality of cavities 5 as is also indicated in FIG. 7. On the other side of the shell 3, the cavities 5 correspond to bulges 27 that define male tools as indicated in FIG. 6. The outer surface 10 of the tool thus corresponds to a male forming tool (or several male forming tools). As further indicated in FIG. 8, the cavity 5 or cavities 5 are filled with loose objects 6 such as spheres 6.

It should be understood that the inventive forming tool could also be shaped as a female tool.

Figure 9:
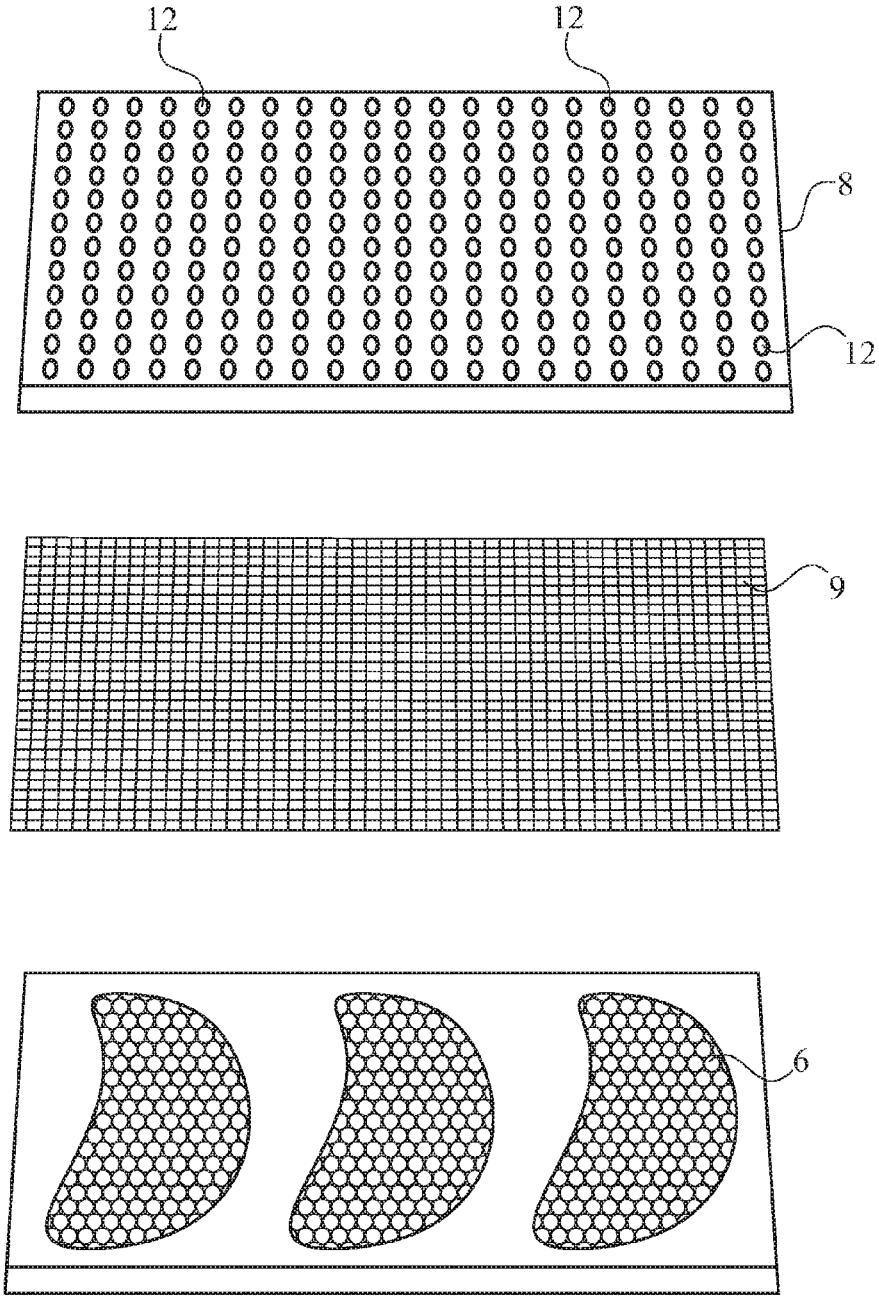
FIG. 9 is an exploded view showing different components of the tool according to the present invention.

As indicated in FIG. 9, the permeable cover 7 may comprise two parts, a relatively stiff cover plate 8 and a flexible net 9. In this context, the term "relatively stiff" should be understood as meaning that the cover plate 8 is stiff compared to the net 9. In absolute terms, it may well have a degree of flexibility. A possible material for the cover plate 8 may be polyvinyl chloride. The net 9 may also be of a plastic material.

With reference to FIG. 9, the stiff cover plate 8 may have through-holes 12 that are larger than the loose objects 6 and the net 9 has a mesh size that is smaller than the loose objects 6. In FIG. 10, the tool 1 is shown with the spheres 6 placed in the cavities 5 of the shell 3 and the net 3 placed over the cavities. The flexible net 9 is used since the through-holes 12 in the cover plate 8 are so large that the loose objects 6 could pass through them. When the tool 1 is mounted, the net 9 is positioned between the loose objects 6 and the cover plate 8. The fine meshes in the net 9 can thus prevent the loose objects is from passing through the holes 12. The cover plate 8 can be used to fasten the tool to a tool plate. The net 9 provides a high permeability without permitting the loose objects 6 to leave the cavity 5 while the relatively stiff cover plate 8 provides structural strength.

In some embodiments of the invention, the permeable cover 7 may be removably attached to the permeable shell 3.

The cover 7 may be glued to the sintered shell 3 (alternatively, it may be removably attached to the shell 3).

Figure 13:
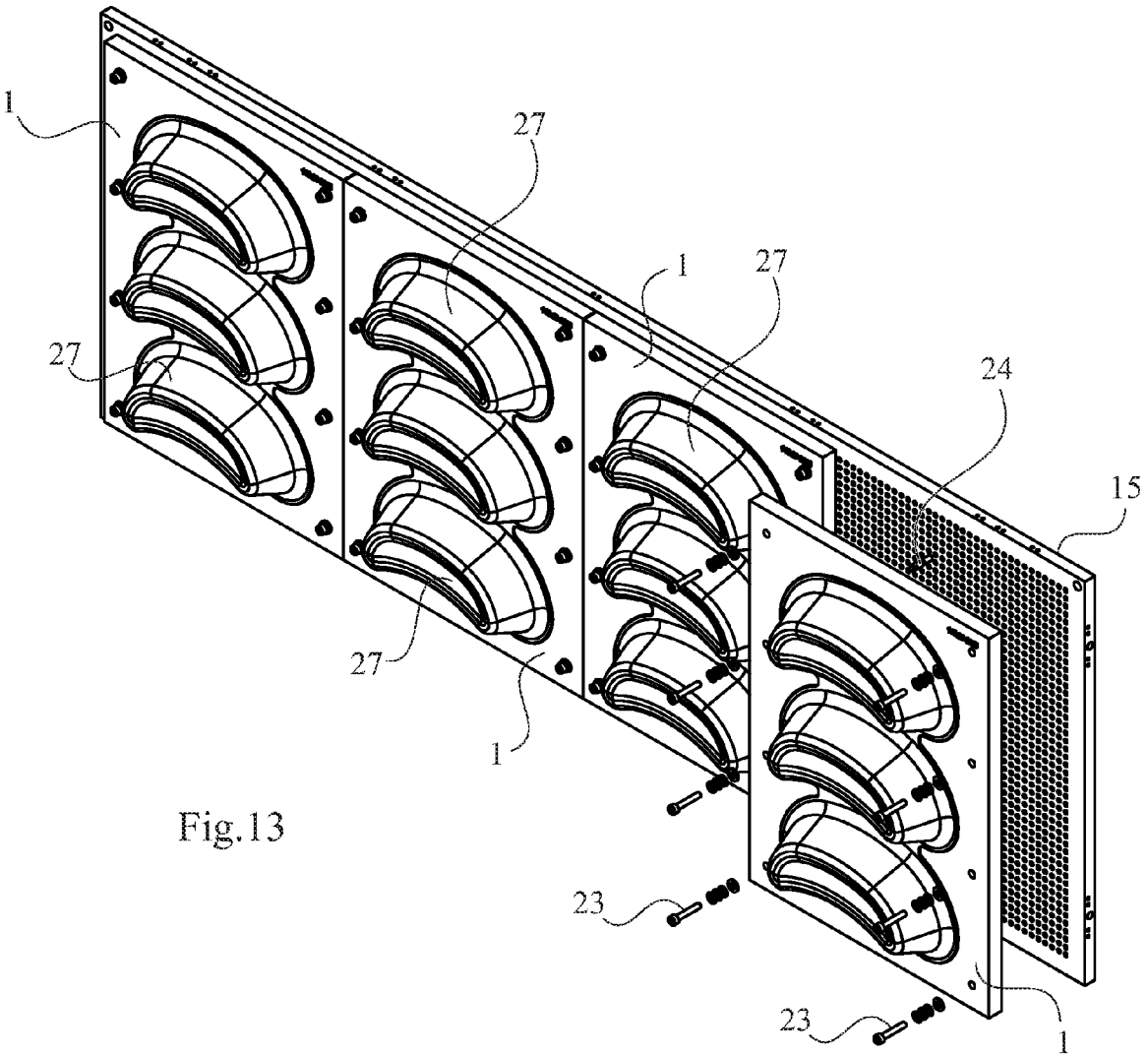
FIG. 13 is a perspective view showing how several tools can be fastened to a tool plate.
Figure 14:
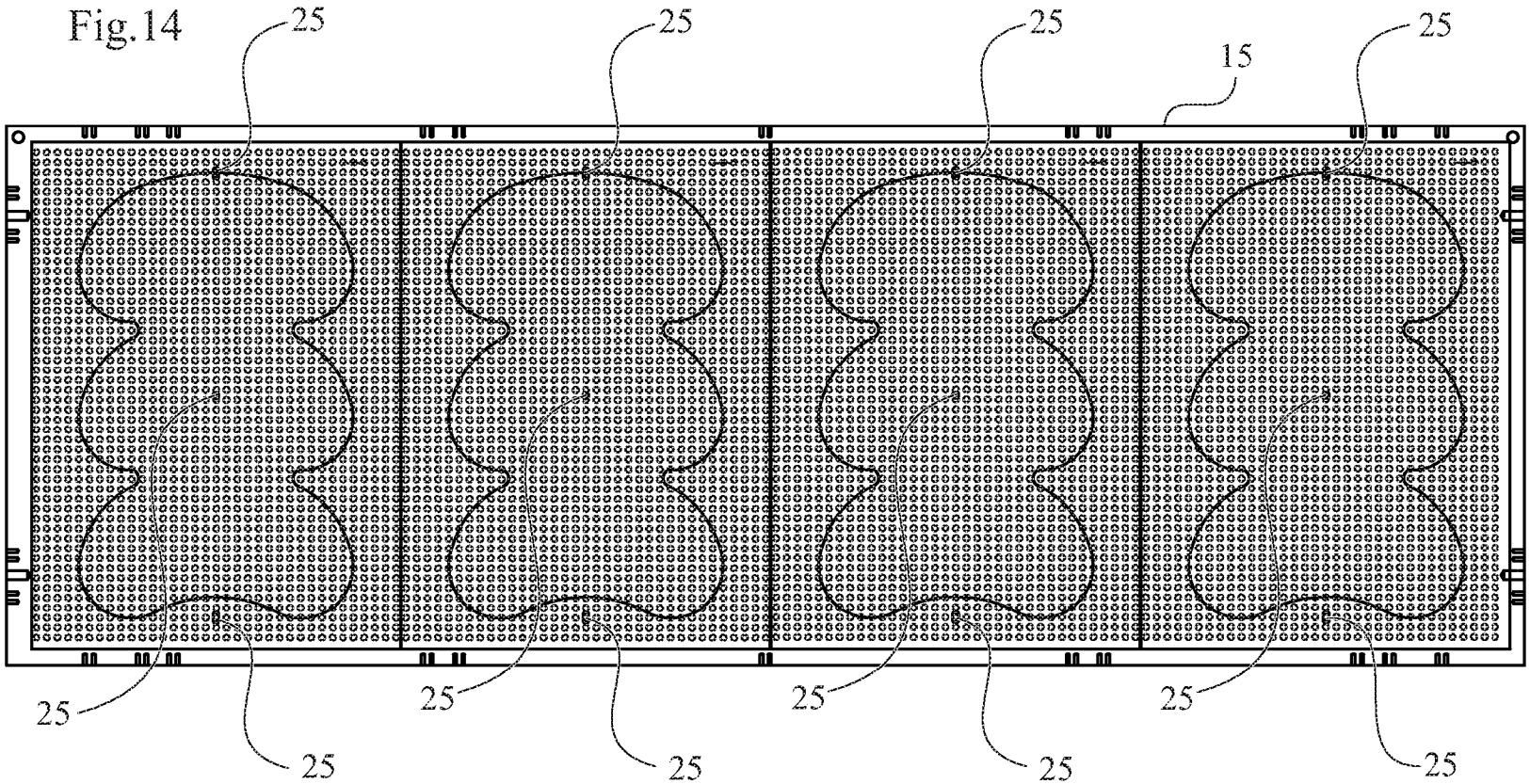
FIG. 14 shows a tool plate on which a plurality of tools can be fastened.
Figure 15:
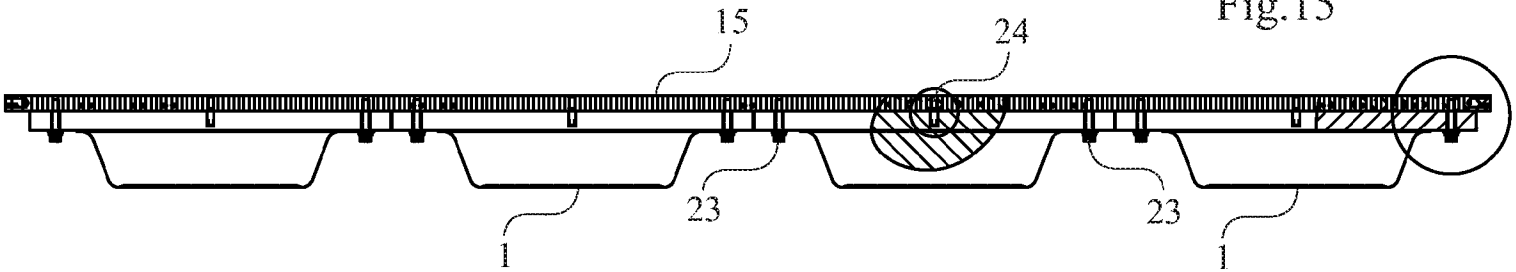
FIG. 15 is a side view, partially in cross-section, of a tool plate on which a plurality of tools has been fastened.
Figure 17:
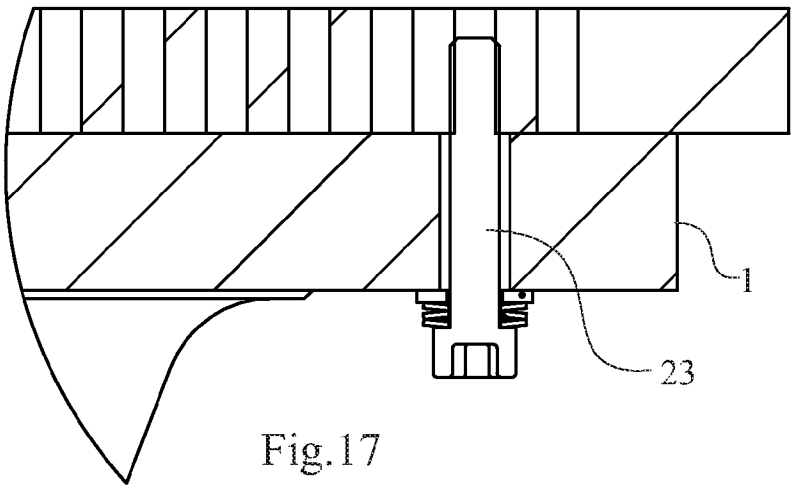
FIG. 17 shows in greater detail and in cross-section an other part of the tool plate of FIG. 15.
Figure 16:
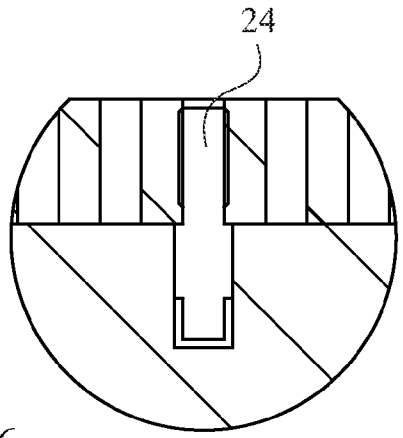
FIG. 16 shows in greater detail and in cross-section a part of the tool plate of FIG. 15.

With reference to FIG. 13, a plurality of tools are shown mounted on a tool plate 15 that is permeable. The tool plate 15 is further illustrated in FIG. 14. As indicated in FIG. 14, the tool plate can have openings 25 in which guide pins can be inserted to secure the tools 1 in a correct position on the tool plate 15. As indicated in FIG. 15 and FIG. 17, the tools 1 can be fastened on the tool plate 15 by means of, for example, screws 23. FIG. 16 shows how a guide pin 24 is used to ensure a correct relative position between the tool 1 and the tool plate 15. This is especially important when the tool 1 is mounted on the tool plate 1. As indicated in FIG. 13, four tools may be placed on each tool plate 15. In order to mount the tools 1 on the tool plates 15, each tool may be guided by three guide pins 24 or centre pins 24, one pin 24 at the centre of the tool and one close to each end. Each tool may be mounted on the tool plate 15 using screws 23. After the mounting of the tools on the tool plates, the edges of the tools which are in contact with the tool plate 15 may optionally be sealed. Sealing can be achieved by, for example, high temperature silicone, e.g. Loctite 5920. The tool plates can later be mounted on a forming unit.

In many realistic embodiments, the forming tool could have such dimensions that are suitable for forming fibre objects that are 20 mm-150 mm deep and 60 mm-150 mm wide. However, it should be understood that other dimensions are also possible. For example, the depth could be less than 20 mm and more than 150 mm. The width of the fibre objects could of course be more than 150 mm. For example, they could very well be up to 220 mm wide or even more. Both regular and irregular objects may be shaped.

Figure 18:
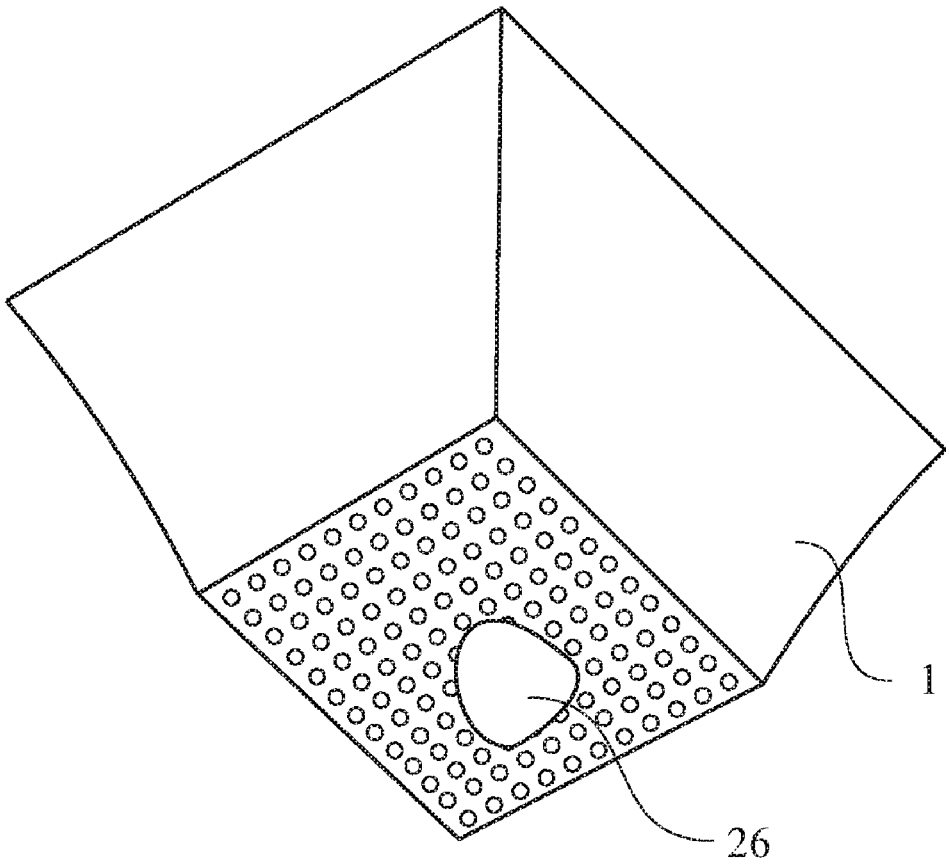
FIG. 18 shows a possible further embodiment of the invention.

FIG. 18 shows an embodiment where a tool 1 has a surface that has been painted or covered with an impermeable cover such that the tool 1 has an impermeable part 26. Such a tool 1 can be used to form a fibre object having an opening corresponding to the shape of the impermeable part 26. This particular feature can be used regardless of how the forming tool 1 is otherwise designed.

The invention offers several advantages. The loose objects 6 serve to support the shell 3 when the tool is used. This makes the tool stiffer and reduces the risk that the tool 1 is deformed during use. Moreover, the loose objects 6 provide good permeability. Especially spherical objects 6 result in a very good permeability. Since the loose objects 6 are not bound to each other, permeability is better compared to a design where with objects bound to each other. The use of loose objects (such as loose spheres) also entails the advantage that it becomes easier to manufacture the forming tool. It is not necessary to manufacture a special support for shells of different shape since the loose objects will fill any shell. In case fibres accumulate within the tool 1, the design according to the present invention makes it easier to clean the tool, especially of the cover 7 is removable. To clean the tool, the cover 7 is removed, the spheres 6 taken out and washed. The inner cavity 5 is also washed and the spheres 6 can then be out back and the cover 7 applied again.

Even though separate loose objects 6 are regarded as preferable, embodiments of the invention are possible where such objects have been connected to each other by for example glue, for example spherical objects connected to each other by glue to form a coherent support. The loose objects 6 could also be metal objects (for example balls) that are sintered to each other.

While the invention has been explained in terms of a forming tool, it should be understood that the invention could also be understood in terms of a method for making such a tool, including the steps of forming a sintered shell with a cavity, filling the cavity with loose objects such as plastic spheres and closing the cavity with a permeable cover.

The invention could also be defined in terms of a use for the inventive tool where the tool is used to form fibre objects, i.e. a method for forming fibre objects. Such a method may include cleaning the tool as described above, for example by operating the tool for a period of time to form fibre objects and then removing and cleaning the tool. The tool is then once again used to forms new objects.

The invention claimed is:

1. A forming tool for forming fiber objects, the tool comprising:

a permeable shell formed from sintered particles, the shell partially enclosing an inner cavity of the tool which is filled with loose objects that are not bound to each other; and a permeable cover that together with the permeable shell encloses the cavity such that the loose objects are enclosed between the cover and an inner wall of the shell, wherein the loose objects remain unbound and fill the cavity such that the loose objects are in contact with both the permeable shell and the permeable cover and support the permeable shell during application of suction to the tool when used to form fiber objects.

2. A forming tool according to claim 1, wherein the loose objects are spherical particles.

3. A forming tool according to claim 1, wherein the loose objects are made of a plastic material.

4. A forming tool according to claim 2, wherein the loose objects are made of a plastic material.

5. A forming tool according to claim 1, wherein the permeable shell of the forming tool has an outer surface that corresponds to a male forming tool.

6. A forming tool according to claim 1, wherein the permeable cover comprises a cover plate and a flexible net.

7. A forming tool according to claim 6, wherein the cover plate is made of a polyvinyl chloride.

8. A forming tool according to claim 6, wherein the cover plate has through-holes that are larger than the loose objects and the net has a mesh size that is smaller than the loose objects.

9. A forming tool according to claim 1, wherein the particles in the sintered shell have an average diameter within the range of 0.01-5 mm.

10. A forming tool according to claim 1, wherein the permeable cover is removably attached to the permeable shell.

11. A method of forming a tool for forming fiber objects comprising:

forming a permeable shell of sintered particles, the permeable shell partially enclosing an inner cavity of the tool;

filling the inner cavity with loose objects that are not bound to each other; and enclosing the cavity with a permeable cover that together with the permeable shell encloses the cavity such that the loose objects are enclosed between the cover and an inner wall of the shell, wherein the loose objects remain unbound and fill the cavity such that the loose objects are in contact with both the permeable shell and the permeable cover and support the permeable shell during application of suction to the tool when used to form fiber objects.

12. The method of claim 11, wherein the permeable cover comprises a cover plate and a flexible net.

13. The method of claim 12, wherein the cover plate is made of a polyvinyl chloride.

14. The method of claim 12, wherein the cover plate has through-holes that are larger than the loose objects and the net has a mesh size that is smaller than the loose objects.

15. The method of claim 11, wherein the sintered particles of the permeable shell have an average diameter within the range of 0.01-5 mm.

* * * * *